US006984154B1

(12) United States Patent
Jee

(10) Patent No.: US 6,984,154 B1
(45) Date of Patent: Jan. 10, 2006

(54) CRIMPING MECHANISM OF A TELEPHONE CONNECTOR CRIMPER

(76) Inventor: Beam-Chi Jee, No. 58, Chungshan Rd., Tucheng Industrial Park, Taipei County (TW)

( * ) Notice: Subject to any disclaimer, the term of this patent is extended or adjusted under 35 U.S.C. 154(b) by 30 days.

(21) Appl. No.: 11/041,738

(22) Filed: Jan. 25, 2005

(51) Int. Cl.
*H01R 24/00* (2006.01)

(52) U.S. Cl. ..... 439/676; 29/719

(58) Field of Classification Search ..... 439/676, 439/144, 409, 638, 188, 489, 418, 217–218, 439/142, 342; 29/749, 334, 751–753, 564.8
See application file for complete search history.

(56) References Cited

U.S. PATENT DOCUMENTS 5,355,583 A * 10/1994 Osumi et al. ..... 29/876
6,190,186 B1 * 2/2001 Liao ..... 439/144
6,364,694 B1 * 4/2002 Lien ..... 439/489
6,877,208 B2 * 4/2005 Shirakawa et al. ..... 29/564.2
2001/0014558 A1 * 8/2001 Tucker et al. ..... 439/676
2001/0049233 A1 * 12/2001 Sakakura et al. ..... 439/676
2004/0242077 A1 * 12/2004 Chang ..... 439/676

* cited by examiner

*Primary Examiner*—J. F. Duverne
(74) *Attorney, Agent, or Firm*—Rosenberg, Klein & Lee

(57) ABSTRACT

A crimping mechanism installed in the two jaws of a telephone connector crimper and moved with the jaws relative to each other for crimping holding down blocks and metal conducting strips on a telephone line in a telephone connector is disclosed to include a holder member, which has a first holder chamber and a second holder chamber for accommodating telephone connectors of two different specifications, and a crimping member, which has pressure bars and crimping tips for crimping holding down blocks and metal conducting strips on a telephone line in a telephone connector set in the first holder chamber or second holder chamber of the holder member.

2 Claims, 8 Drawing Sheets

CRIMPING MECHANISM OF A TELEPHONE CONNECTOR CRIMPER

BACKGROUND OF THE INVENTION

1. Field of the Invention

The present invention relates to a telephone connector crimping apparatus and more particularly, to a crimping mechanism for telephone connector crimper, which fits telephone connectors of different specifications.

2. Description of the Related Art

FIG. 7 shows a crimping mechanism installed in the jaws of a telephone connector crimper according to the prior art. FIG. 8 shows another structure of crimping mechanism installed in the jaws of a telephone connector crimper according to the prior art. These two crimping mechanism designs are similar with the exception of the size to fit different sizes of telephone connectors 8;8'. According to these two designs, the crimping mechanism comprises a crimping member 6;6' and a holder member 7;7'. The holder member 7;7' comprises a holder chamber 71;71' for accommodating a telephone connector 8; 8'. The crimping member 6;6' comprises a bottom pressure bar 61;61', and a row of crimping tips 62;62' for crimping a holding down block 81;81' and metal conducting strips 82;82' in a telephone connector 8;8' to affix a telephone line to the telephone connector 8;8'. These conventional crimping mechanisms are still not satisfactory in function due to the following drawbacks.

1. These crimping mechanisms fit only one particular model of telephone connector. For crimping telephone connectors of different specifications, different crimping mechanisms shall be used.

2. Because different crimping mechanisms must be prepared for crimping telephone connectors of different specifications, much tool cost is required. Further, it is inconvenient to carry telephone connector crimpers having different crimping mechanisms. It also requires much storage space to keep telephone connector crimpers having different crimping mechanisms.

SUMMARY OF THE INVENTION

The present invention has been accomplished under the circumstances in view. It is therefore the main object of the present invention to provide a crimping mechanism for telephone connector crimper, which fits telephone connectors of different specifications.

According to one aspect of the present invention, the crimping mechanism is installed in the two jaws of a telephone connector crimper and moved with the jaws relative to each other for crimping holding down blocks and metal conducting strips on a telephone line in a telephone connector, comprising a holder member, which has a first holder chamber and a second holder chamber for accommodating telephone connectors of two different specifications, and a crimping member, which has pressure bars and crimping tips for crimping holding down blocks and metal conducting strips on a telephone line in a telephone connector set in the first holder chamber or second holder chamber of the holder member. According to another aspect of the present invention, the crimping member has two bottom guide flanges, and the holder member has two top guide holes adapted to receive the bottom guide flanges of the crimping member, ensuring accurate crimping operation.

DETAILED DESCRIPTION OF THE PREFERRED EMBODIMENT

Figure 1:
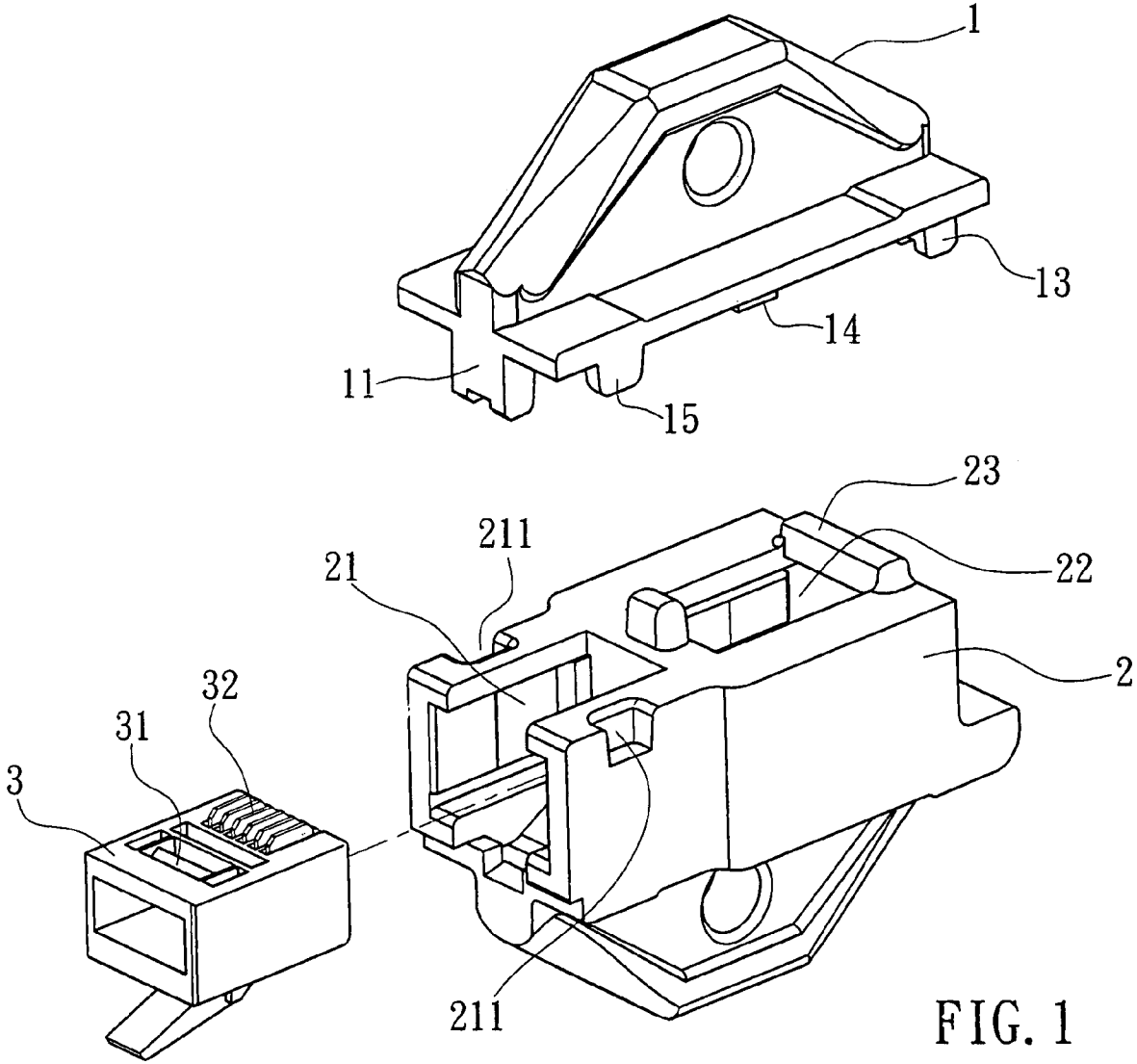
FIG. 1 is an exploded view of a crimping mechanism corresponding to a telephone connector of a first specification according to the present invention.
Figure 2:
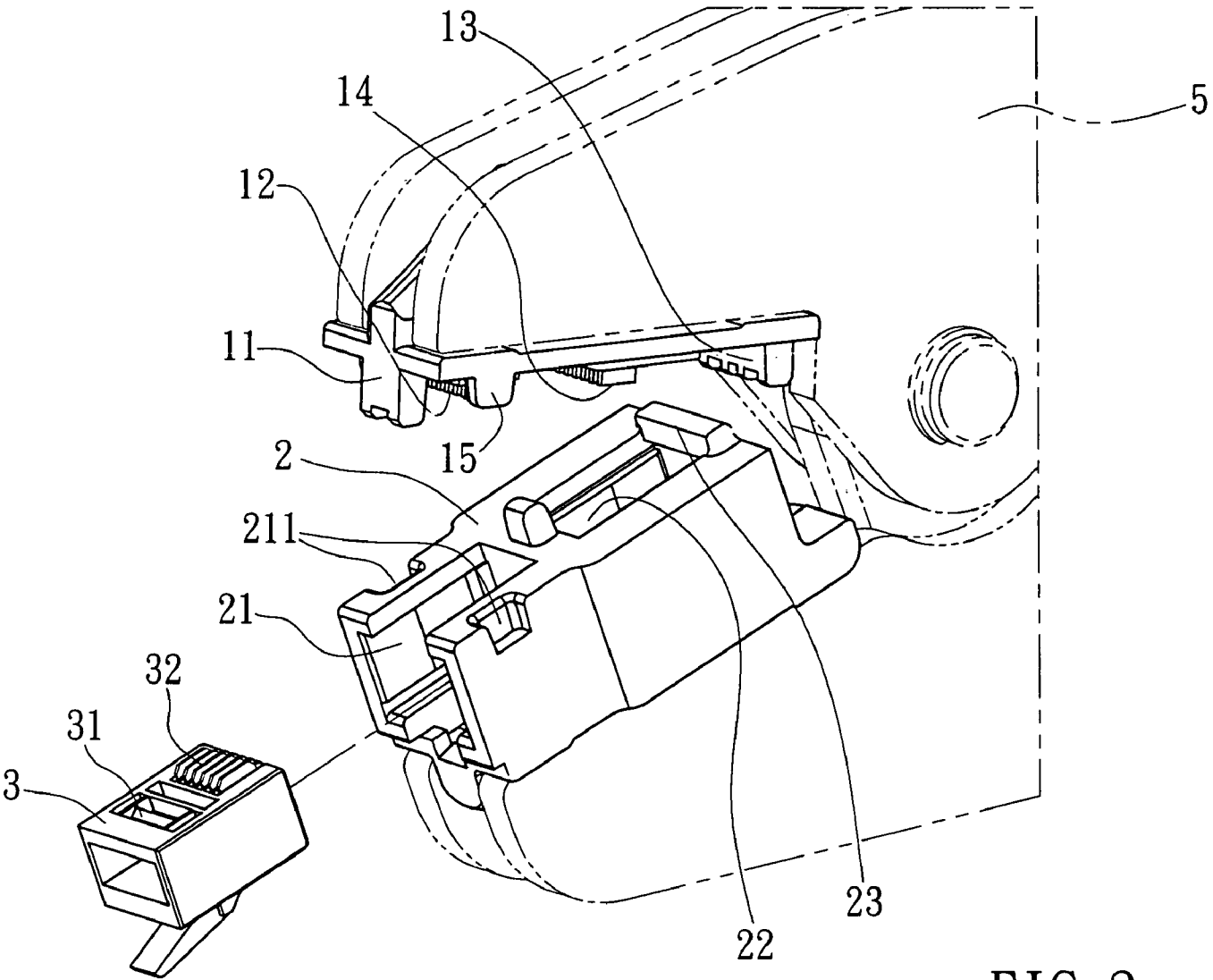
FIG. 2 is a schematic drawing showing one installation example of the crimping mechanism in the jaws of a telephone connector crimper according to the present invention.
Figure 3:
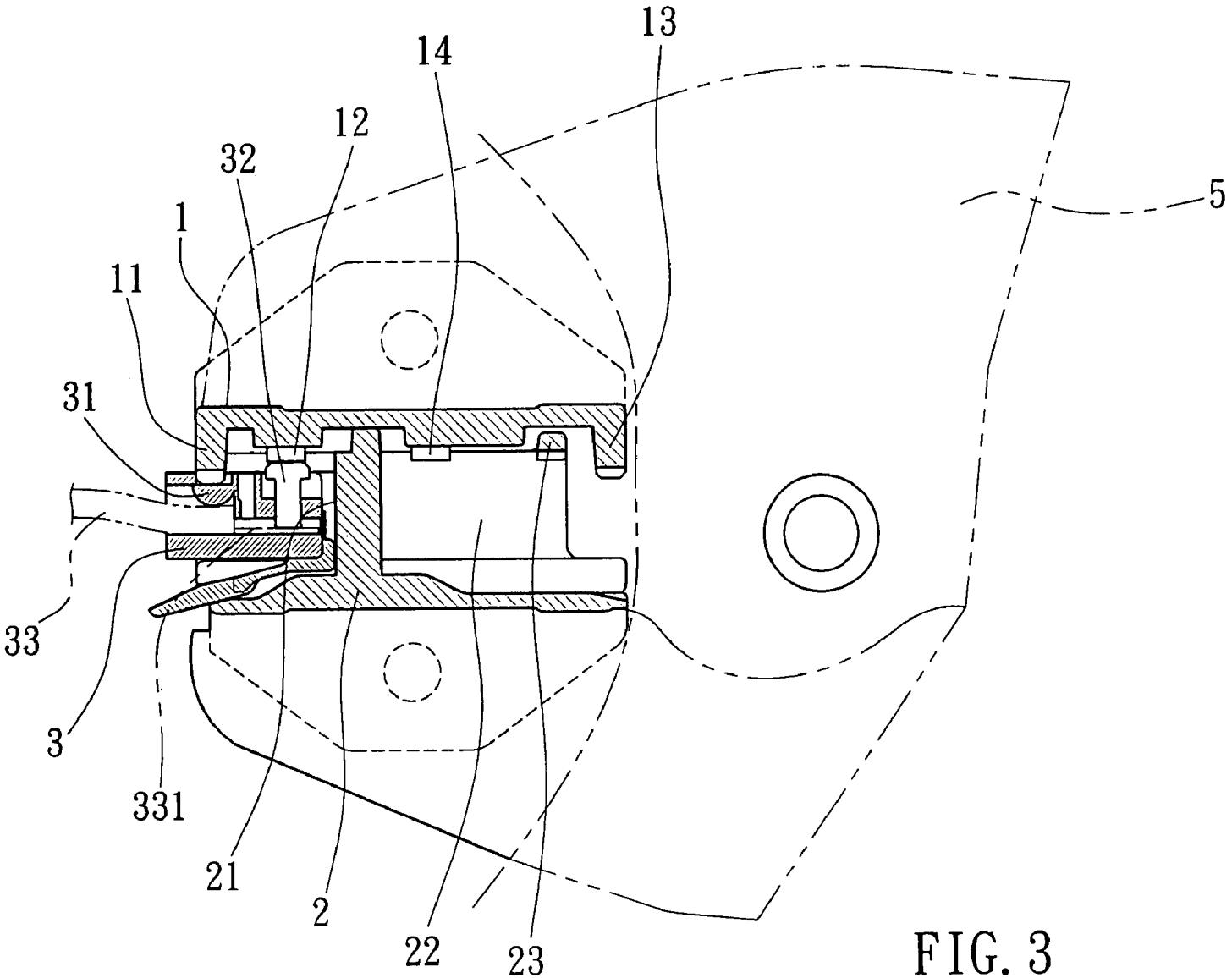
FIG. 3 is a sectional view showing the crimping action of the telephone connector crimper of FIG. 2.
Figure 4:
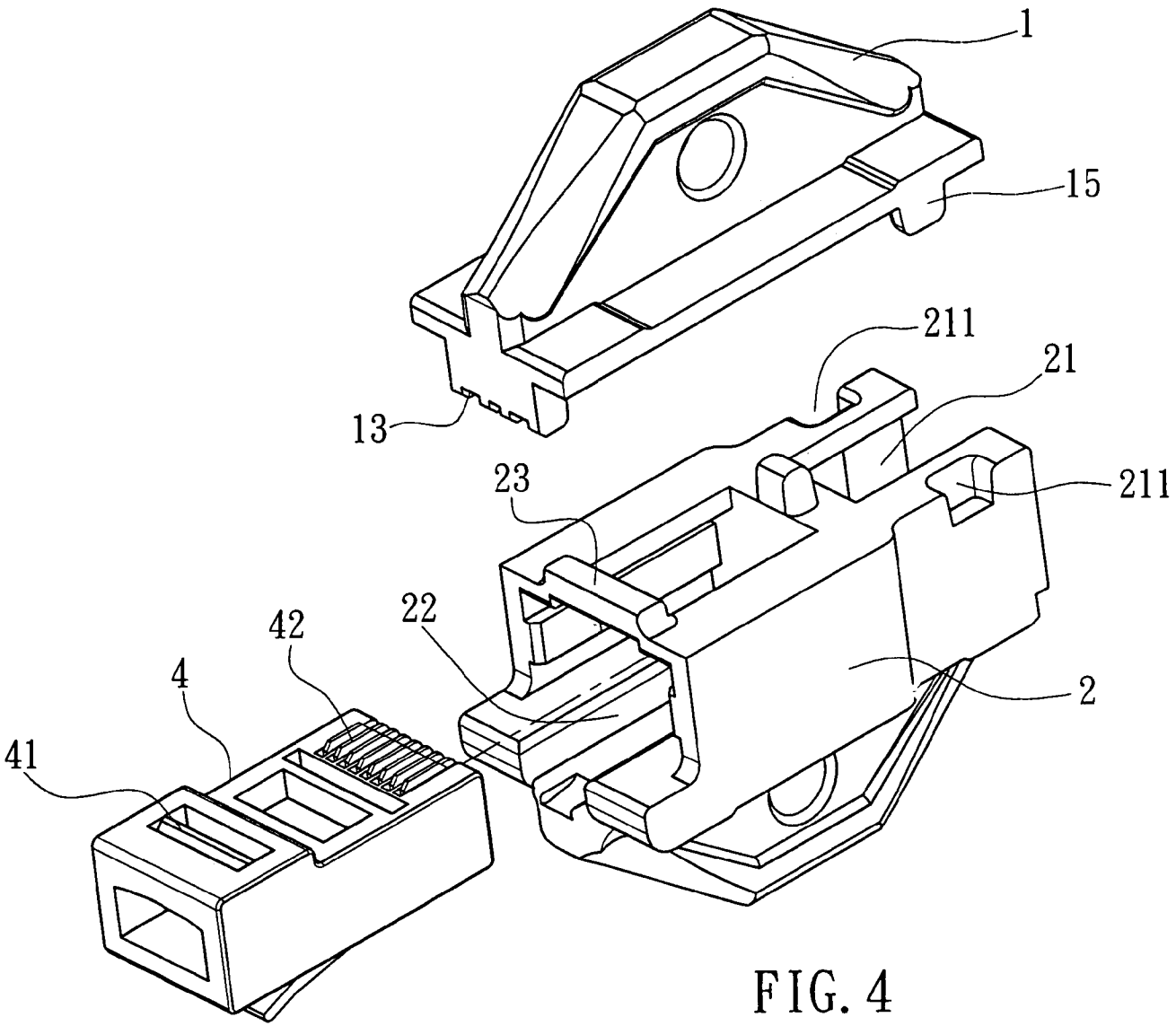
FIG. 4 is an exploded view of the crimping mechanism corresponding to a telephone connector of a second specification according to the present invention.
Figure 5:
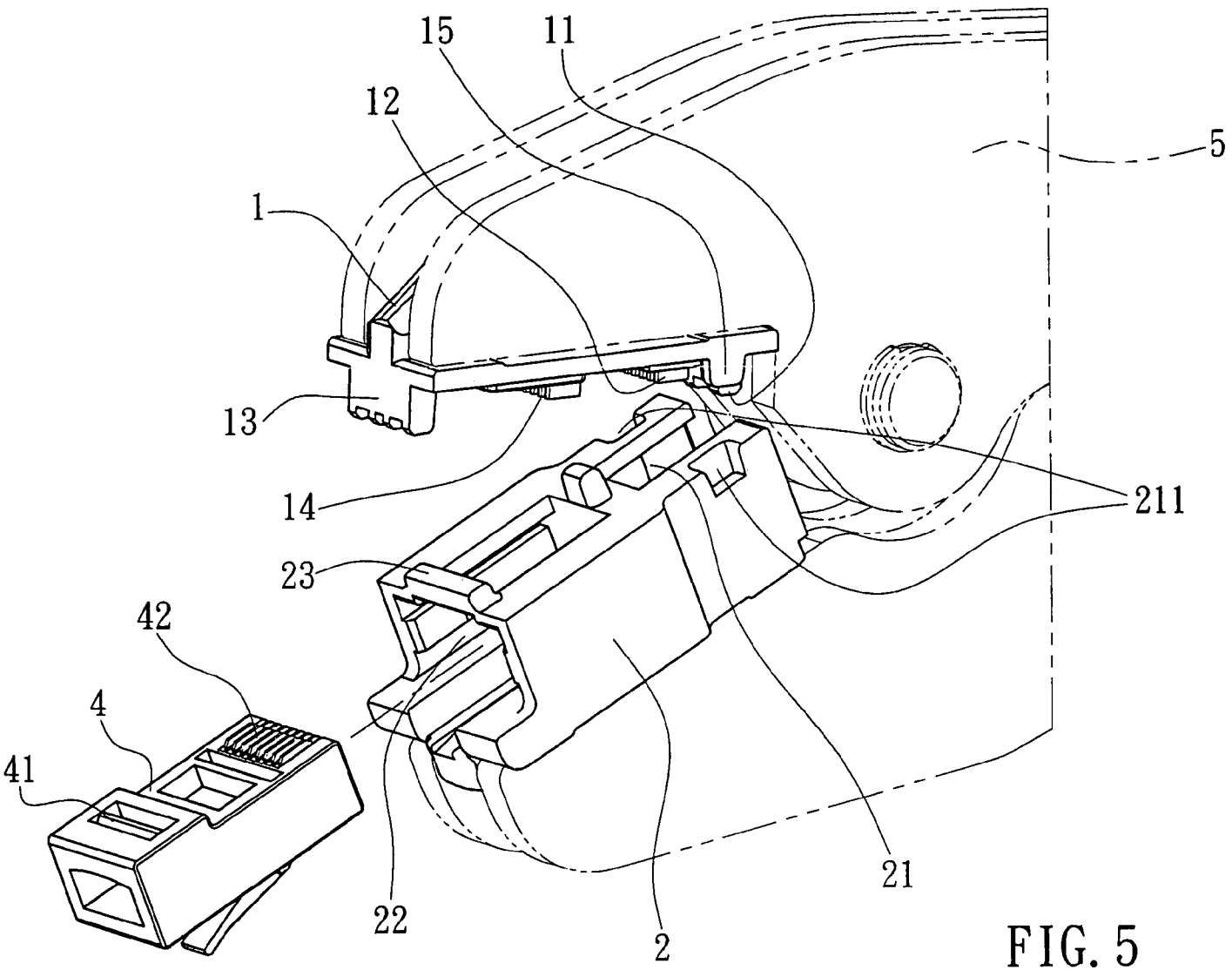
FIG. 5 is a schematic drawing showing another installation example of the crimping mechanism in the jaws of a telephone connector crimper according to the present invention.
Figure 6:
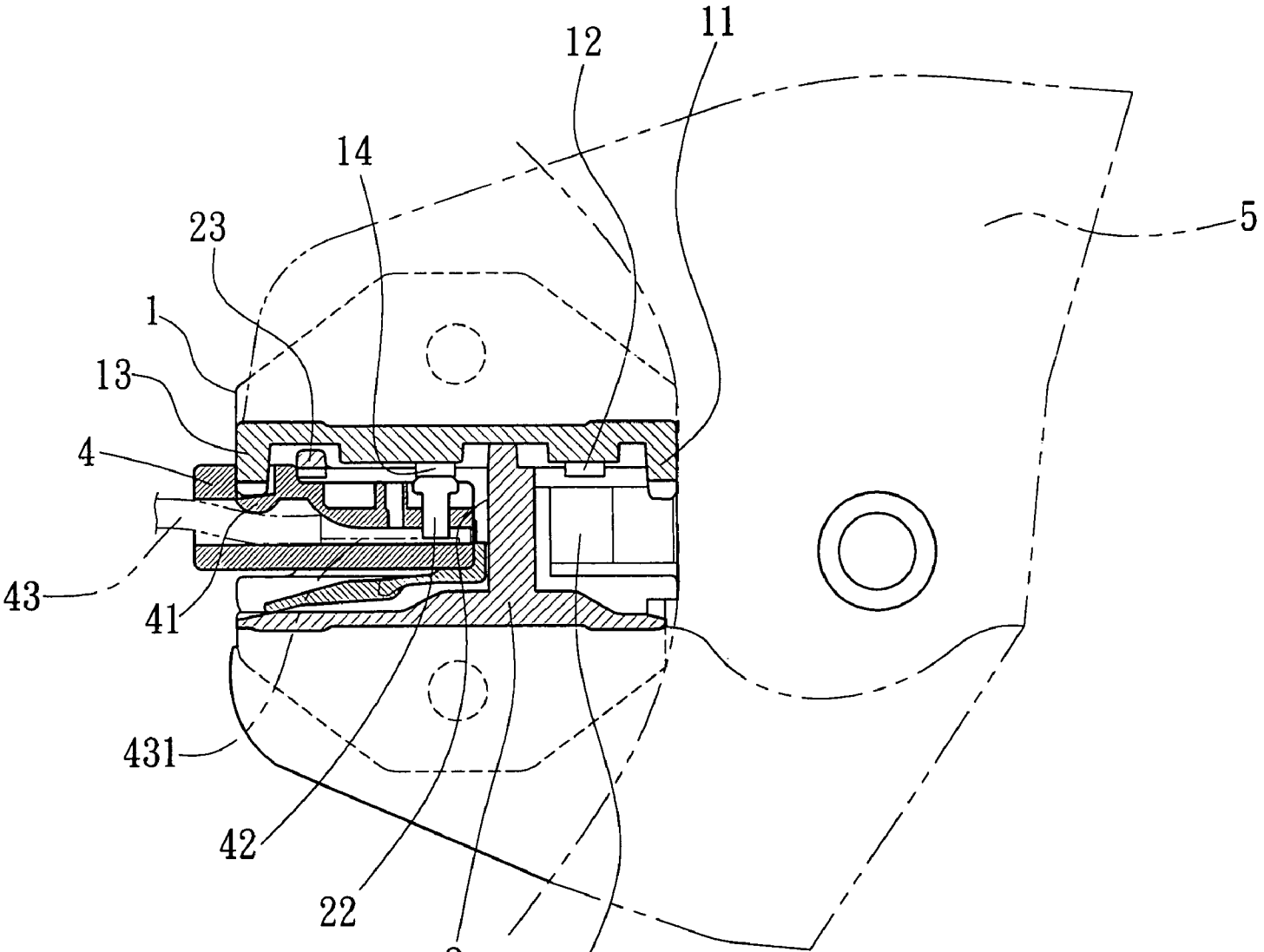
FIG. 6 is a sectional view showing the crimping action of the telephone connector crimper of FIG. 5.
Figure 7:
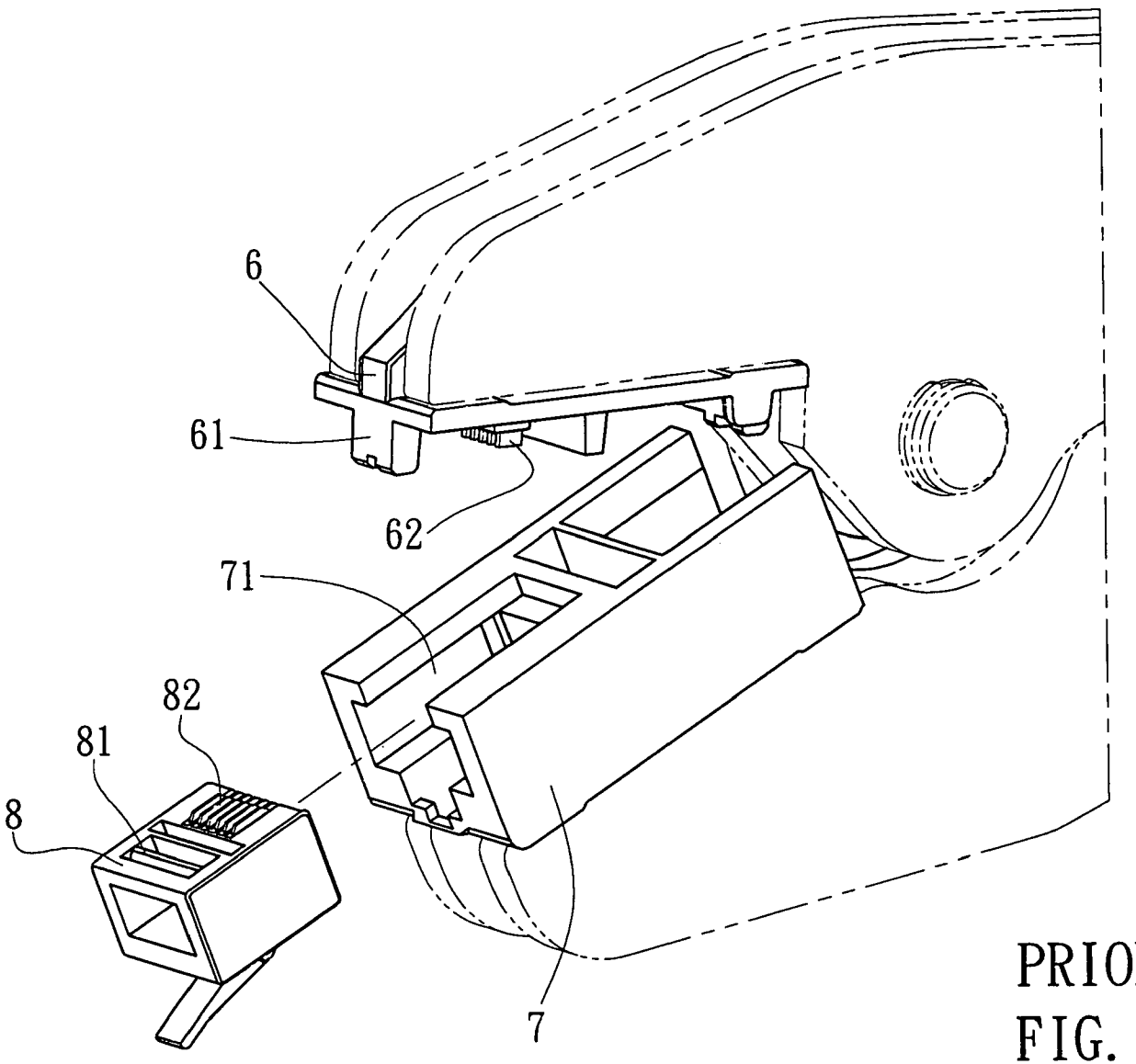
PRIOR ART FIG. 7
FIG. 7 illustrates a crimping mechanism installed in the jaws of a telephone connector crimper according to the prior art.
Figure 8:
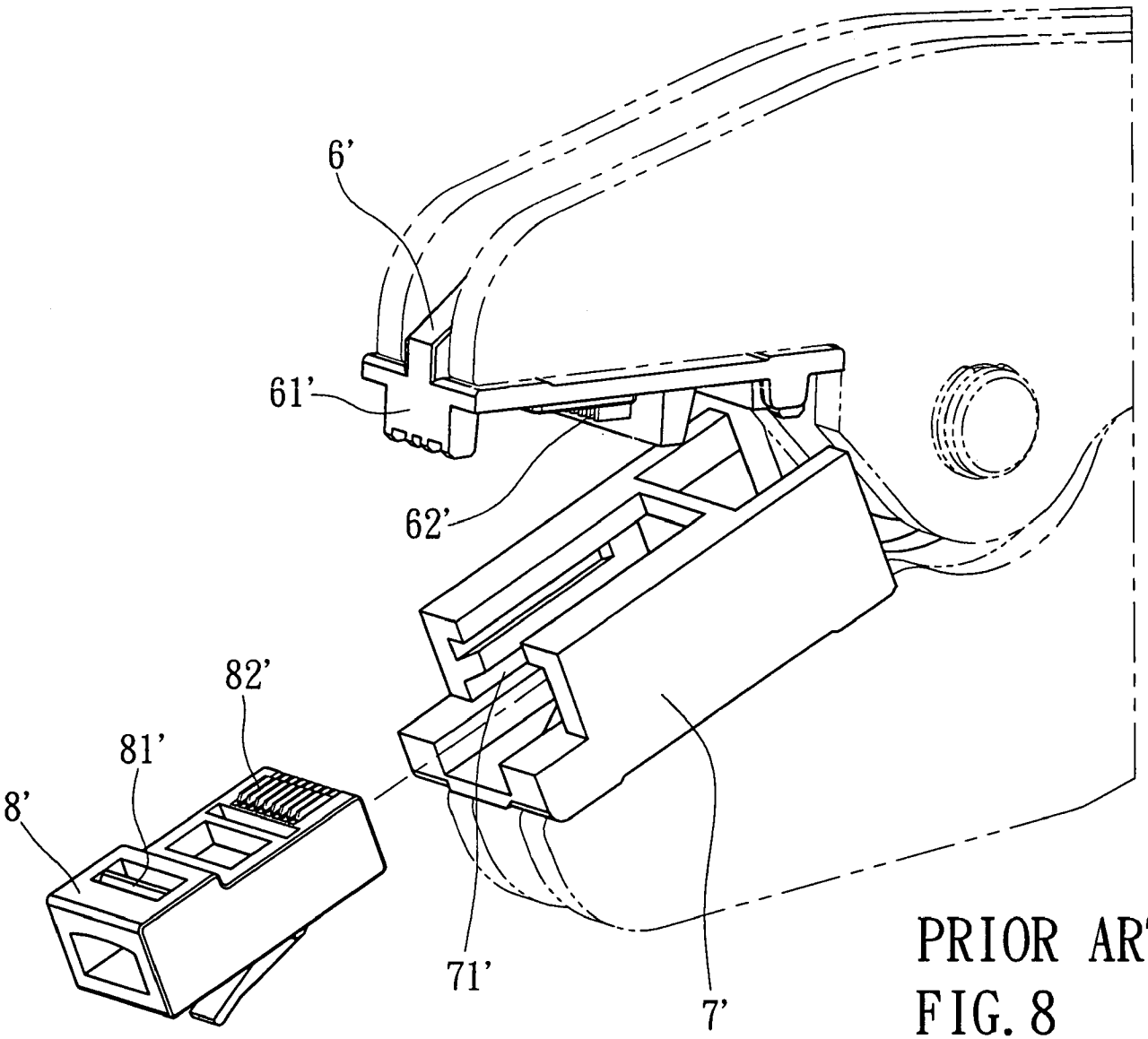
PRIOR ART FIG. 8
FIG. 8 illustrates another structure of crimping mechanism installed in the jaws of a telephone connector crimper according to the prior art.

Referring to FIGS. 1–6, a crimping mechanism is installed in the jaws of a telephone connector crimper 5, comprising a holder member 2 and a crimping member 1. The holder member 2 and the crimping member 1 are movable with the jaws of the telephone connector crimper 5 relative to each other to crimp electric wires in a telephone connector 3 or 4. The holder member 2 comprises a first holder chamber 21 for accommodating a small telephone connector 3, a second holder chamber 22 for accommodating a big telephone connector 4, and a reinforcing bar 23 formed integral with the top side of the peripheral wall of the second holder chamber 22 to reinforce the structural strength of the holder member 2. The crimping member 1 comprises a set of bottom pressure bars 11 and 13, and plural rows of crimping tips 12 and 14 corresponding to the first holder chamber 21 and second holder chamber 22 of the holder member 2 for crimping a holding down block 31 or 41 and metal conducting strips 32 or 42 in a small telephone connector 3 or big telephone connector 4 to affix a telephone line 33 or 43 to the small telephone connector 3 or big telephone connector 4 and to keep the wires 331 or 431 of the telephone line 33 or 43 in positive contact with the respective metal conducting strips 32 or 42 of the telephone connector 3 or 4.

The holder member 2 and the crimping member 1 can be selectively fastened to the jaws of the telephone connector crimper 5 between two reversed positions (see FIGS. 2 and 5) subject to the specification of the telephone connector to be crimped.

Further, the crimping member 1 comprises two bottom guide flanges 15 symmetrically disposed at two opposite lateral sides, and the holder member 2 comprises two top guide holes 211 adapted to receive the bottom guide flanges 15 to ensure accurate crimping operation of the telephone connector crimper 5.

A prototype of crimping mechanism of a telephone connector crimper has been constructed with the features of the annexed drawings of FIGS. 1–6. The crimping mechanism of a telephone connector crimper functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A crimping mechanism installed in the two jaws of a telephone connector crimper, comprising:

a holder member fastened to one jaw of said telephone connector crimper, said holder member comprising a first holder chamber adapted to accommodate a telephone connector of a first specification, and a second holder chamber adapted to accommodate a telephone connector of a second specification; and a crimping member fastened to the other jaw of said telephone connector crimper, said crimping member comprising a first bottom pressure bar insertable into said first holder chamber for crimping a holding down block, a second bottom pressure bar insertable into said second holder chamber for crimping a holding down block, a first row of crimping tips insertable into said first holder chamber for crimping metal conducting strips, and a second row of crimping tips insertable into said second holder chamber for crimping metal conducting strips.

2. The crimping mechanism as claimed in claim 1, wherein said crimping member comprises two bottom guide flanges symmetrically disposed at two opposite lateral sides thereof; said holder member comprises two top guide holes adapted to receive the bottom guide flanges of said crimping member.

* * * * *